US006196734B1

(12) United States Patent
Templeton et al.

(10) Patent No.: US 6,196,734 B1
(45) Date of Patent: Mar. 6, 2001

(54) CD UNIFORMITY BY ACTIVE CONTROL OF DEVELOPER TEMPERATURE

(75) Inventors: Michael K. Templeton, Atherton; Bharath Rangarajan, Santa Clara, both of CA (US)

(73) Assignee: Advanced Micro Devices, Sunnyvale, CA (US)

( * ) Notice: Subject to any disclaimer, the term of this patent is extended or adjusted under 35 U.S.C. 154(b) by 0 days.

(21) Appl. No.: 09/410,955

(22) Filed: Oct. 5, 1999

(51) Int. Cl.[7] ..... G03D 5/00; G03D 13/00

(52) U.S. Cl. ..... 396/571; 396/578; 396/611

(58) Field of Search ..... 396/571, 578, 396/579, 567, 570; 219/216; 355/53, 77, 27–29

(56) References Cited

U.S. PATENT DOCUMENTS

| | | | |
|---|---|---|---|
| 4,518,848 | 5/1985 | Weber | 219/388 |
| 4,859,572 | 8/1989 | Farid et al. | 430/281 |
| 5,167,078 | 12/1992 | Bolde et al. | 34/23 |
| 5,716,763 | 2/1998 | Benoit et al. | 430/330 |

FOREIGN PATENT DOCUMENTS

| | | | |
|---|---|---|---|
| 2-13958 * | 1/1990 | (JP) | 396/FOR 942 |
| 3-259511 * | 11/1991 | (JP) | 396/FOR 942 |

* cited by examiner

*Primary Examiner*—D. Rutledge
(74) *Attorney, Agent, or Firm*—Amin, Eschweiler & Turocy, LLP

(57) ABSTRACT

A system for regulating temperature of a developer is provided. The system includes a plurality of optical fibers, each optical fiber directing radiation to respective portions of the developer. Radiation reflected from the respective portions are collected by a measuring system which processes the collected radiation. The reflected radiation are indicative of the temperature of the respective portions of the developer. The measuring system provides developer temperature related data to a processor which determines the temperature of the respective portions of the developer. The system also includes a plurality of heating devices; each heating device corresponds to a respective portion of the developer and provides for the heating thereof. The processor selectively controls the heating devices so as to regulate temperature of the respective portions of the developer.

20 Claims, 6 Drawing Sheets

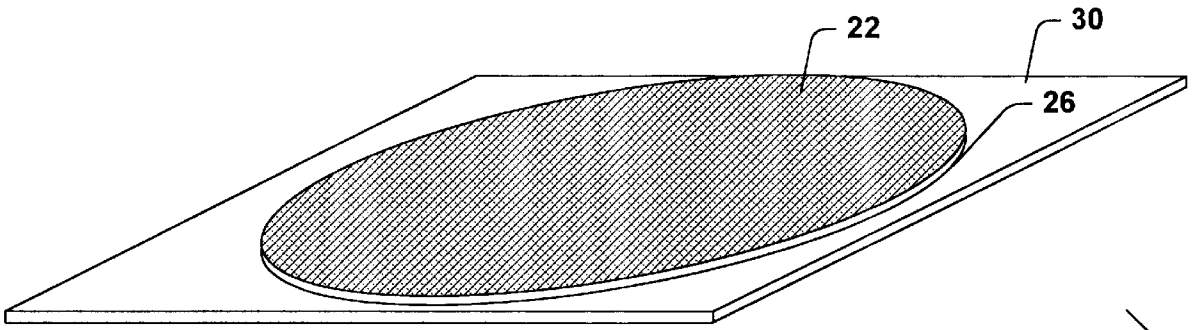

Fig. 2

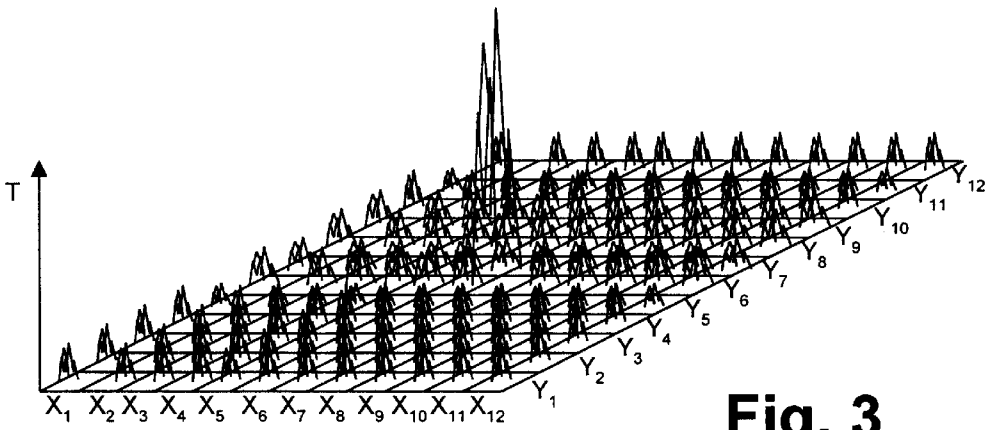

Fig. 3

| | $X_1$ | $X_2$ | $X_3$ | $X_4$ | $X_5$ | $X_6$ | $X_7$ | $X_8$ | $X_9$ | $X_{10}$ | $X_{11}$ | $X_{12}$ |
|---|---|---|---|---|---|---|---|---|---|---|---|---|
| $Y_1$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_2$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_3$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_4$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_5$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_6$ | $T_A$ | $T_A$ | $T_A$ | $T_A$ | $T_A$ | $T_A$ | $T_U$ | $T_A$ | $T_A$ | $T_A$ | $T_A$ | $T_A$ |
| $Y_7$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_8$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_9$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_{10}$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_{11}$ | $T_A$ | $T_A$ | $T_A$ | $T_A$ | $T_A$ | $T_A$ | $T_A$ | $T_A$ | $T_A$ | $T_A$ | $T_A$ | $T_A$ |
| $Y_{12}$ | $T_A$ | $T_A$ | $T_A$ | $T_A$ | $T_A$ | $T_A$ | $T_A$ | $T_A$ | $T_A$ | $T_A$ | $T_A$ | $T_A$ |

Fig. 4

CD UNIFORMITY BY ACTIVE CONTROL OF DEVELOPER TEMPERATURE

TECHNICAL FIELD

The present invention generally relates to semiconductor processing, and in particular to a system for regulating developer temperature.

BACKGROUND OF THE INVENTION

In the semiconductor industry, there is a continuing trend toward higher device densities. To achieve these high densities there has been and continues to be efforts toward scaling down device dimensions (e.g., at submicron levels) on semiconductor wafers. In order to accomplish such high device packing density, smaller and smaller features sizes are required. This may include the width and spacing of interconnecting lines, spacing and diameter of contact holes, and the surface geometry such as corners and edges of various features.

The requirement of small features with close spacing between adjacent features requires high resolution photolithographic processes. In general, lithography refers to processes for pattern transfer between various media. It is a technique used for integrated circuit fabrication in which a silicon slice, the wafer, is coated uniformly with a radiation-sensitive film, the resist, and an exposing source (such as optical light, x-rays, or an electron beam) illuminates selected areas of the surface through an intervening master template, the mask, for a particular pattern. The lithographic coating is generally a radiation-sensitive coating suitable for receiving a projected image of the subject pattern. Once the image is projected, it is indelibly formed in the coating. The projected image may be either a negative or a positive image of the subject pattern. Exposure of the coating through a photomask causes the image area to become either more or less soluble (depending on the coating) in a particular solvent developer. The more soluble areas are removed in the developing process to leave the pattern image in the coating as less soluble polymer.

Due to the extremely fine patterns which are exposed on the photoresist, application and maintaining a desired temperature of the developer are significant factors in achieving desired critical dimensions. The developer should be maintained at a uniform temperature in order to insure uniformity and quality of the underlying photoresist layer to be developed. Small changes in the time/temperature history of the developer can substantially alter image sizes, resulting in lack of image line control—a few degrees in temperature difference may drastically effect critical dimensions. For example, often substantial line size deviations occur when the developer temperature is not maintained within 0.5 degree tolerance across a silicon wafer.

An efficient system/method to maintain developer temperature is therefore desired to increase fidelity in image transfer.

SUMMARY OF THE INVENTION

The present invention provides for a system which facilitates controlling developer temperature. A preferred embodiment of the system employs a plurality of optical fibers arranged to project radiation on respective portions of the developer. The radiation reflected from the developer is indicative of at least one of several parameters of the developer (e.g., thickness, color and absorption) which vary in correlation with developer temperature. A plurality of heaters are arranged to each correspond to a particular developer portion, respectively—each heater is responsible for heating the particular developer portion. The developer temperature is monitored by the system, and the heaters are selectively driven by the system so as to maintain developer temperature at a desired level. As a result, substantial uniformity in developer temperature is achieved, which in turn increases fidelity of image transfer.

One particular aspect of the invention relates to a system for regulating developer temperature. At least one lamp operates to heat a portion of a developer, and a lamp driving system drives the at least one lamp. A system for directing radiation directs radiation to the portion of the developer, and a measuring system measures parameters of the developer based on radiation reflected from the developer. A processor is operatively coupled to the measuring system and a lamp driving system, the processor receives developer parameter data from the measuring system and the processor uses the data to at least partially base control of the at least one lamp so as to regulate temperature of the at least a portion of the developer.

Yet another aspect of the present invention relates to a method for regulating developer temperature, comprising the steps of defining a developer as a plurality of portions; directing radiation onto at least one of the portions; collecting radiation reflected from the at least one portion; analyzing the reflected radiation to determine the temperature of the at least one portion; and controlling a heating device to regulate the temperature of the at least one portion.

Still another aspect of the present invention relates to a method for regulating temperature of a developer, comprising the steps of: partitioning the developer into a plurality of grid blocks; using a plurality of heaters to heat the developer, each heater functionally corresponding to a respective grid block; determining temperatures of portions of the developer, each portion corresponding to a respective grid block; and using a processor to coordinate control of the heaters, respectively, in accordance with determined temperatures of the respective portions of the developer.

Another aspect of the present invention relates to a system for regulating temperature of a developer including: means for sensing temperatures of a plurality of portions of the developer; means for heating the respective developer portions; and means for selectively controlling the means for heating so as to regulate temperature of the respective developer portions.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

FIG. 2 is a perspective illustration of a substrate (including photoresist) having a developer formed thereon in accordance with the present invention;

FIG. 3 is a representative three-dimensional grid map of a developer illustrating temperature amplitudes taken at grid blocks of the grid map in accordance with the present invention;

FIG. 4 is a temperature amplitude table correlating the temperature amplitudes of FIG. 3 with desired values for the temperature amplitudes in accordance with the present invention.

DETAILED DESCRIPTION OF THE INVENTION

Figure 1A:
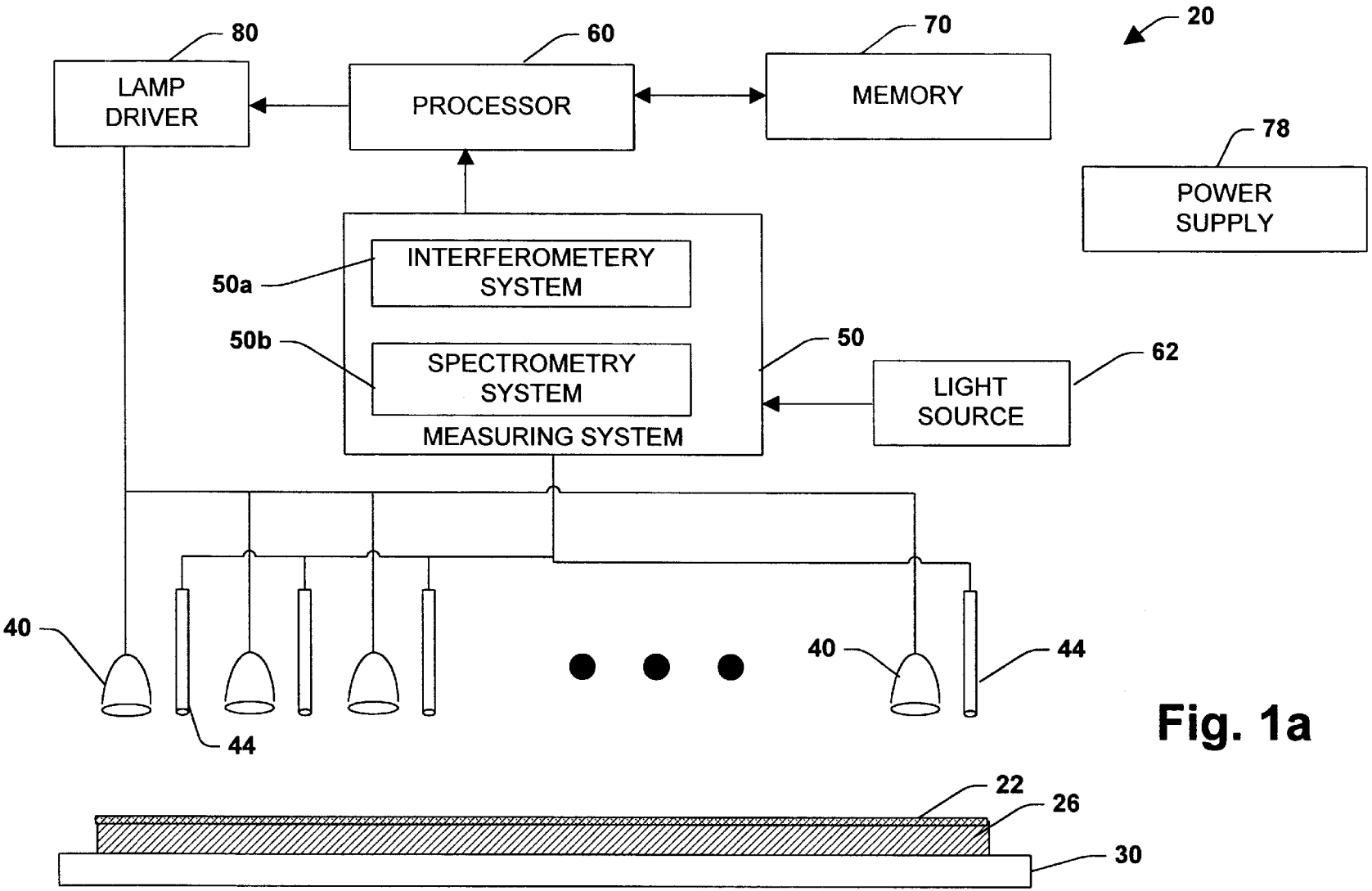
FIG. 1*a* is schematic block diagram of a developer heating system in accordance with the present invention.

The present invention will now be described with reference to the drawings, wherein like reference numerals are used to refer to like elements throughout. The present invention will be described with reference to a system for controlling developer heating temperature using a plurality of heaters. The following detailed description is of the best modes presently contemplated by the inventors for practicing the invention. It should be understood that the description of these preferred embodiments are merely illustrative and that they should not be taken in a limiting sense.

Referring initially to FIG. 1*a*, a system 20 for heating substantially uniformly a developer 22 is shown. Furthermore, although the present invention is primarily described within the context of heating developer, it is to be understood that the present invention may be applied to heating of top and bottom anti-reflective coatings, low K dielectric materials, photo resist spin-on-glass (SOG) and other spin-on materials. The substrate 26 (including photo resist formed thereon) is supported over a chuck 30.

The system 20 further includes a plurality of heat lamps 40 which are selectively controlled by the system 20 so as to facilitate uniform heating of the developer 22. A plurality of optical fibers 44 project radiation onto respective portions of the developer 22. Radiation reflected from the developer 22 is processed by a developer parameter measuring system 50 to measure at least one parameter relating to the temperature of the developer 22. The reflected radiation is processed with respect to the incident radiation in measuring the various parameters.

The measuring system 50 includes an interferometry system 50*a* and a spectrometry system 50*b*. It is to be appreciated that any suitable interferometry system and/or spectrometry system may be employed to carry out the present invention and such systems are intended to fall within the scope of the hereto appended claims. Interferometry systems and spectrometry systems are well known in the art, and therefore further discussion related thereto is omitted for sake of brevity.

A source 62 of monochromatic radiation such as a laser or polychromatic radiation, for example, provides radiation to the plurality of optical fibers 44 via the measuring system 50. Preferably, the radiation source 62 is a frequency stabilized laser however it will be appreciated that any laser or other radiation source (e.g., laser diode or helium neon (HeNe) gas laser) suitable for carrying out the present invention may be employed.

A processor 60 receives the measured data from the measuring system 50 and determines the temperature of respective portions of the developer 22. The processor 60 is operatively coupled to system 50 and is programmed to control and operate the various components within the developer heating system 20 in order to carry out the various functions described herein. The processor or CPU 60 may be any of a plurality of processors, such as the AMD K7 and other similar and compatible processors. The manner in which the processor 60 can be programmed to carry out the functions relating to the present invention will be readily apparent to those having ordinary skill in the art based on the description provided herein.

A memory 70 which is operatively coupled to the processor 60 is also included in the system 20 and serves to store program code executed by the processor 60 for carrying out operating functions of the system 20 as described herein. The memory 70 also serves as a storage medium for temporarily storing information such as developer temperature, temperature tables, developer coordinate tables, interferometry information, spectrometry information and other data which may be employed in carrying out the present invention.

Power supply 78 provides operating power to the system 20. Any suitable power supply (e.g., battery, line power) may be employed to carry out the present invention.

The processor 60 is also coupled to a lamp driving system 80 which drives the heat lamps 40. The lamp driving system 80 is controlled by the processor 60 so as to selectively vary heat output of the respective heat lamps 40. Each respective portion of the developer 22 has a corresponding lamp 40 and optical fiber 44 associated therewith. The processor 60 is able to monitor the temperature of the various developer portions and selectively regulate the temperatures of each portion via the corresponding heat lamps 40. As a result, the system 20 provides for regulating heating temperature of the developer 22 with substantial uniformity, which in turn improves fidelity of image transfer in a lithographic process employing the developer 22.

Figure 1B:
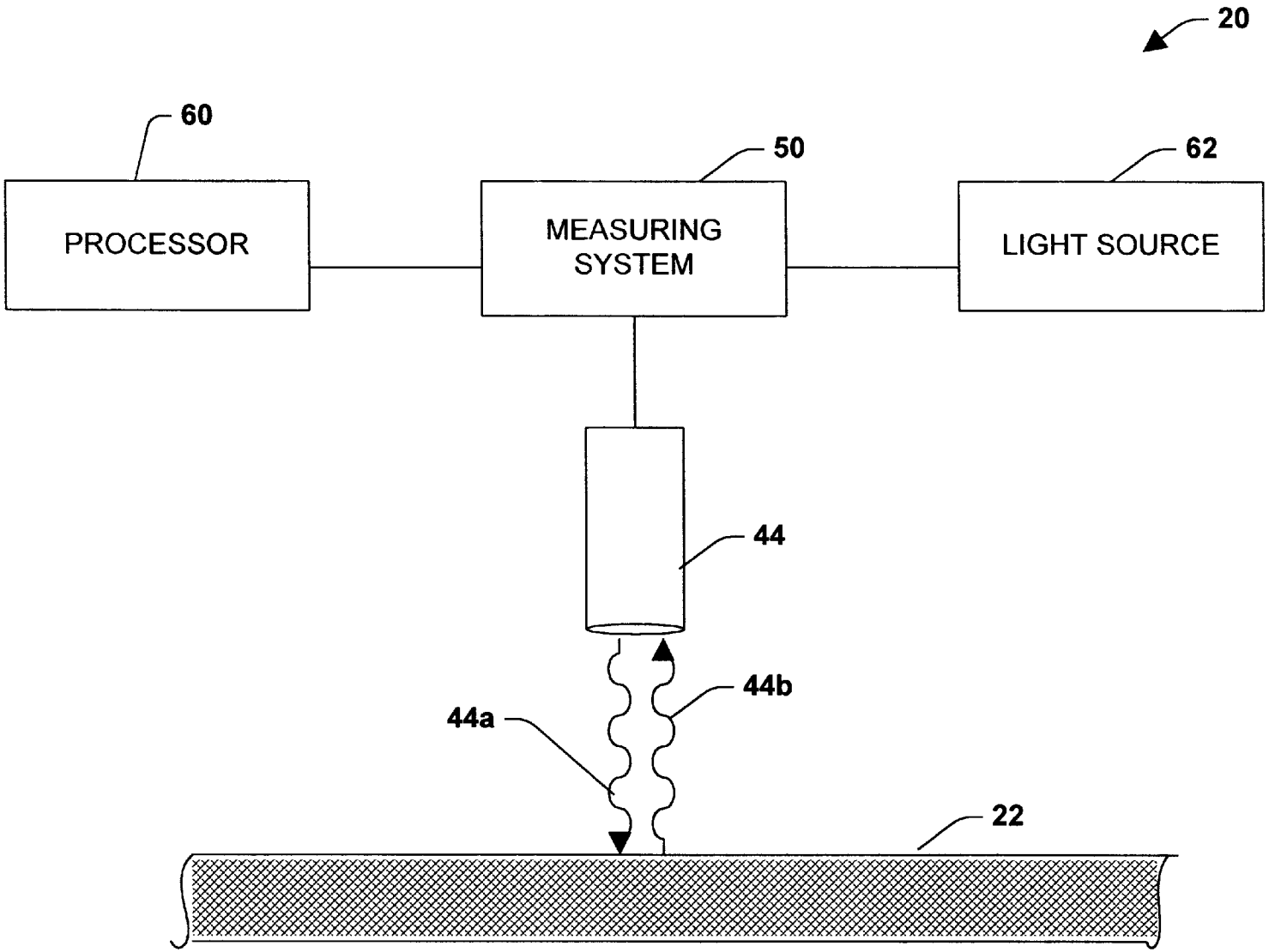
FIG. 1*b* is a partial schematic block diagram of the system of FIG. 1*a* being employed in connection with determining developer temperature by measuring developer thickness in accordance with the present invention.

FIG. 1*b* illustrates the system 20 being employed to measure thickness of the developer 22 at a particular portion. The temperature of the developer 22 will have an impact on the thickness thereof. The optical fiber 44 directs radiation 44*a* incident to the surface of the developer 22, and the phase and/or intensity of reflected radiation 44*b* from the surface of developer will vary in accordance with the thickness of the developer 22. The measuring system 50 collects the reflected radiation 44*b* and processes the reflected radiation 44*b* in accordance with interferometry and/or spectrometry techniques to provide the processor 60 with data corresponding to the thickness of the developer 22. The processor 60 analyzes the data and determines the temperature of the developer 22.

Figure 1C:
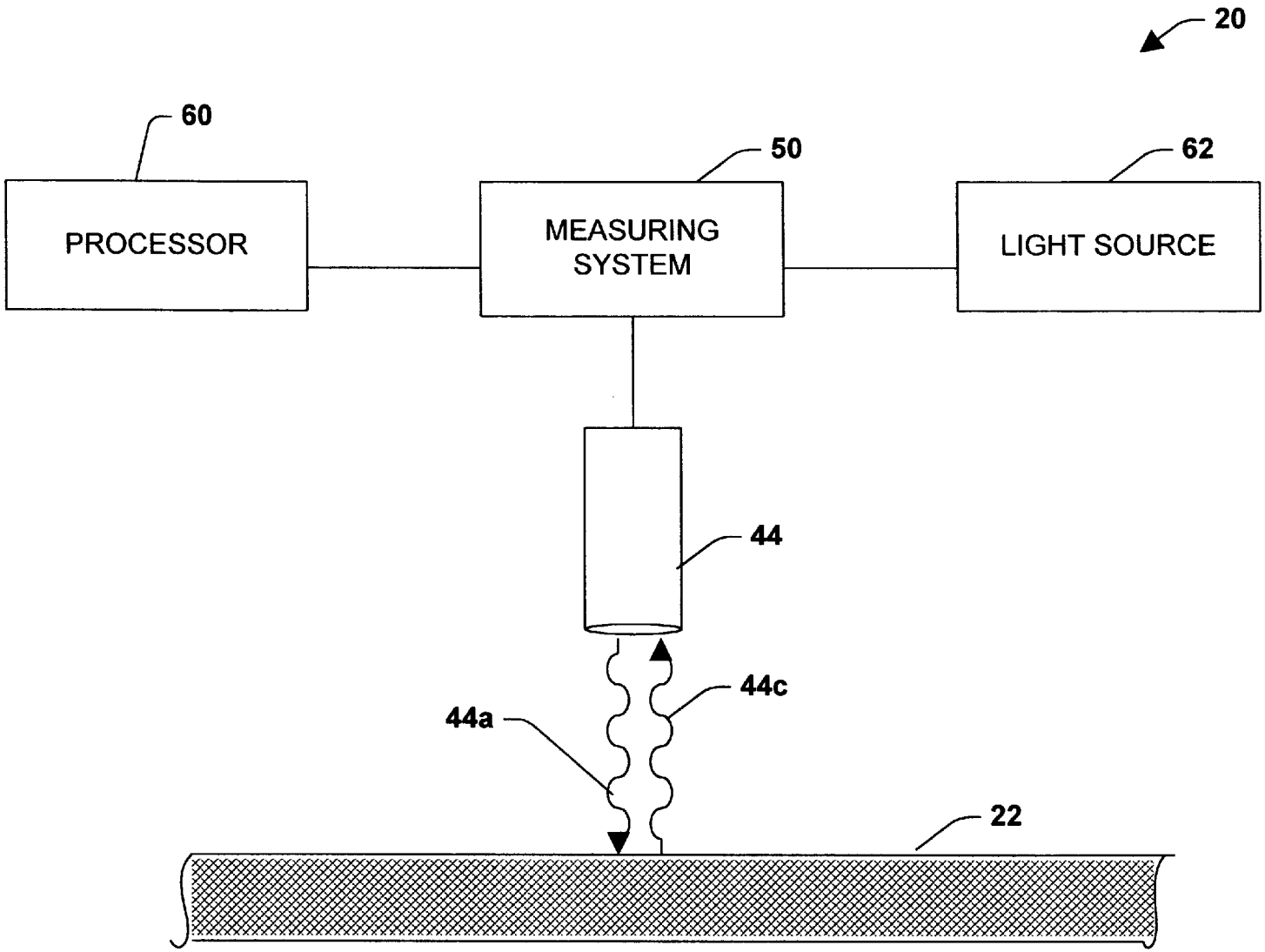
FIG. 1*c* is a partial schematic block diagram of the system of FIG. 1*a* being employed in connection with determining developer temperature by measuring developer color in accordance with the present invention.

FIG. 1*c* illustrates the system being used to measure fluorescence of the developer 22. A substantially inert fluorescence material (e.g. europium chelate) is combined with the developer 22 such that the color of the developer 22 will vary in accordance with the temperature thereof. The inert fluorescence material is selected so as to not impede the performance of the developer 22. It is to be appreciated that any suitable material which provides for temperature related color change of the developer 22 without affecting the performance of the developer 22 may be employed and is intended to fall within the scope of the hereto appended claims. The optical fiber 44 directs the radiation 44*a* incident to the surface of the developer and the phase of reflected radiation 44*c* will vary in accordance with the color of the developer 22. The measuring system 50 collects the reflected radiation 44*b* and processes the reflected radiation 44*b* in accordance with spectrometry techniques to provide the processor 60 with data corresponding to the color of the developer 22. The processor 60 analyzes the data and determines the temperature of the developer 22.

Figure 1D:
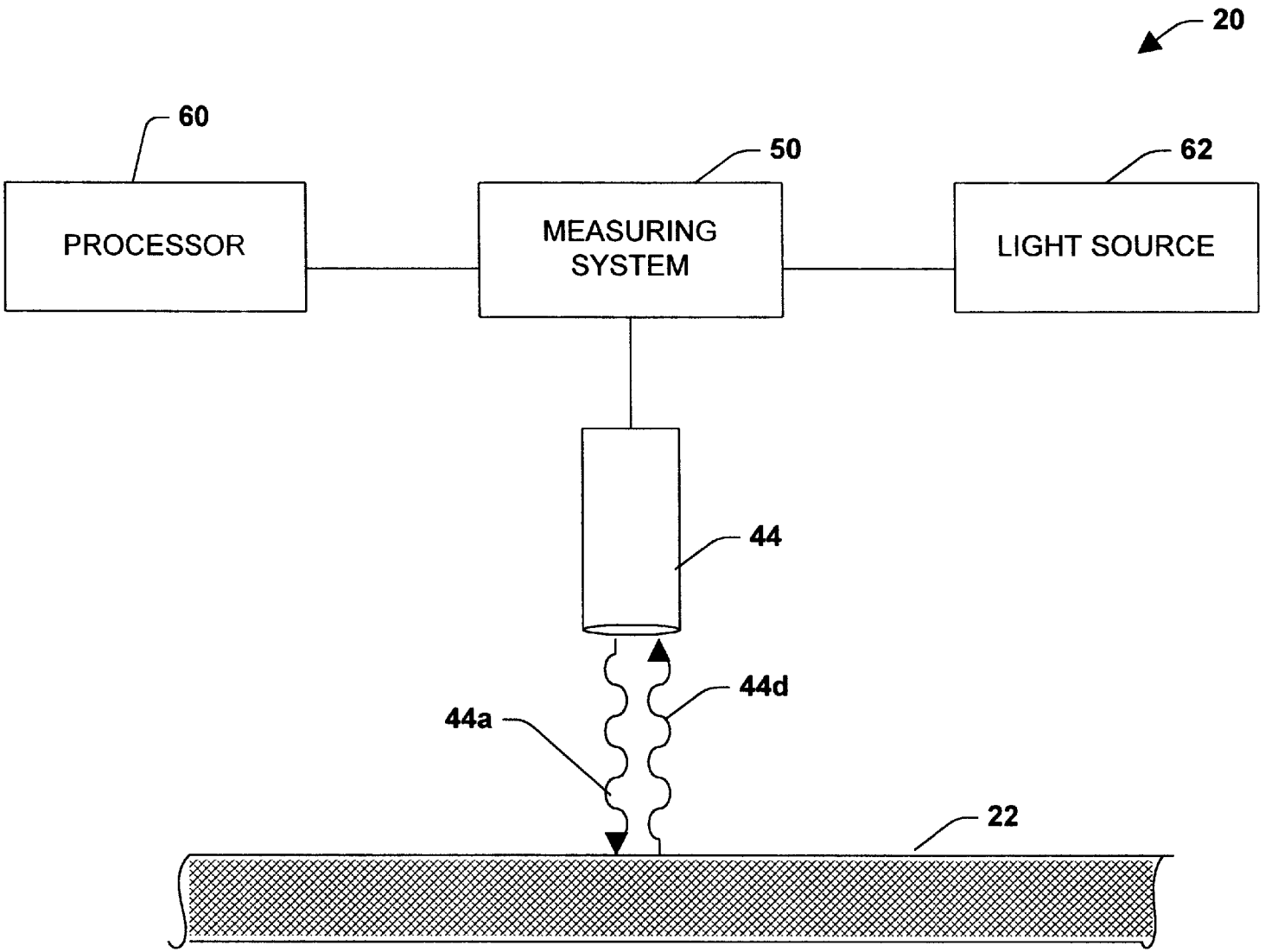
FIG. 1*d* is a partial schematic block diagram of the system of FIG. 1*a* being employed in connection with determining developer temperature by measuring developer absorptivity in accordance with the present invention.

Yet another parameter that may be measured by the system 20 is absorptivity of the developer 22 as shown in FIG. 1*d* . The absorption of the incident radiation 44*a* by the developer 22 corresponds to the temperature of the developer 22. Accordingly, the phase and/or intensity of reflected radiation 44*d* will be indicative of the absorptivity of the developer 22 which in turn is indicative of developer temperature. The measuring system 50 collects the reflected radiation 44*d* and processes the reflected radiation 44*d* in accordance with interferometry and/or spectrometry techniques to provide the processor 60 with data corresponding to the absorptivity of the developer 22. The processor 60 analyzes the data and determines the temperature of the developer 22.

It is to be appreciated that although FIGS. 1*a*–4 are described herein with respect to heating the developer 22, these same figures may be used to represent heating of any other suitable material (e.g., top and bottom anti-reflective coatings, low K dielectric materials, photoresist, spin-on-glass (SOG) and other spin-on materials) and those figures may be schematically referenced by numeral 22 of these figures.

Turning now to FIGS. 2–4 the chuck 30 is shown in perspective supporting the substrate 26 having developer 22 thereon. The developer heating system 20 provides for regulating the temperature of the developer 22 during the above described heating process in order to facilitate uniform heating of the developer 22. The developer 22 may be divided into a grid pattern as that shown in FIG. 3. Each grid block (XY) of the grid pattern corresponds to a particular portion of the developer 22, and each portion is individually monitored for temperature as well as controlled for temperature.

In FIG. 3, each respective portion of the developer ($X_1Y_1$ . . . $X_{12}$, $Y_{12}$) is being monitored for temperature using a respective optical fiber 44, the measuring system 50 and the processor 60. The temperature amplitudes of each developer portion is shown. As can be seen, the temperature of the developer at coordinate $X_7Y_6$ is substantially higher than the temperature of the other developer portions XY. It is to be appreciated that although FIG. 3 illustrates the developer 22 being mapped (partitioned) into 144 grid block portions, the developer 22 may be mapped with any suitable number of portions. Although the present invention is described with respect to one optical fiber 44 corresponding to one lamp 40 which correspond to one grid block XY, it is to be appreciated that any suitable number of optical fibers 44 may correspond to any suitable number of lamps 40 and vice versa, and the like for grid blocks XY.

FIG. 4 is a representative table of temperature amplitudes (taken at the various grid blocks which have been correlated with acceptable temperature amplitude values for the portions of the developer 22 mapped by the respective grid blocks. As can be seen, all of the grid blocks except grid block $X_7Y_6$ have temperature amplitudes corresponding to an acceptable temperature value ($T_A$) (e.g., are within an expected range of temperature amplitudes), while grid block $X_7Y_6$ has an undesired temperature value ($T_U$). Thus, the processor 60 has determined that an undesirable temperature condition exists at the portion of the developer 22 mapped by grid block $X_7Y_6$. Accordingly, the processor 60 can drive the lamp $\mathbf{40}_{7,6}$ which corresponds to the portion of the developer 22 mapped at grid block $X_7Y_6$ so as to bring the temperature of this portion of the developer 22 down to an acceptable level. It is to be appreciated that the lamps 40 may be driven so as to increase and/or decrease the temperature of the respective developer portions as desired.

Figure 5:
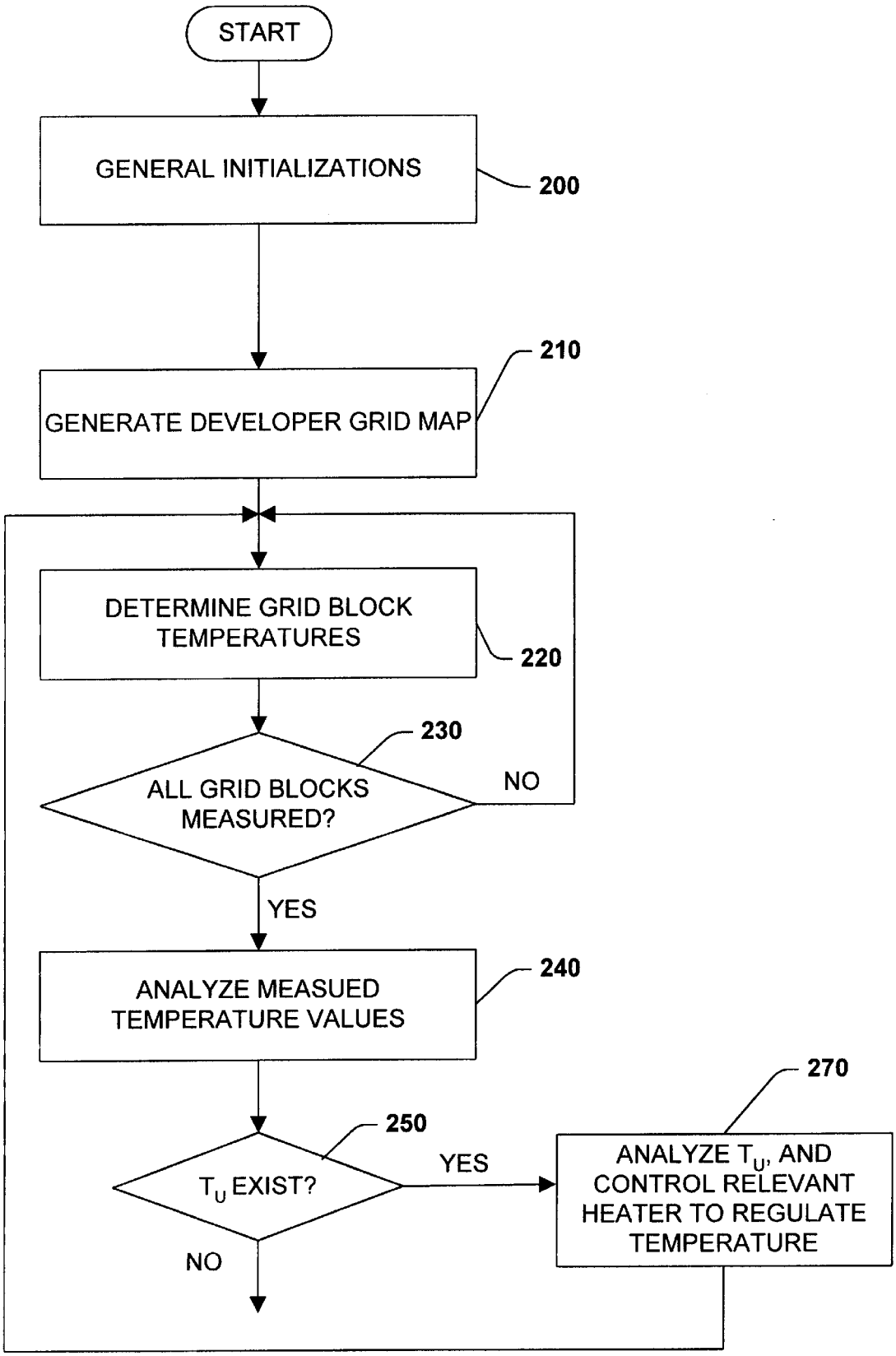
FIG. 5 is a flow diagram illustrating one specific methodology for carrying out the present invention.

FIG. 5 is a flow diagram illustrating one particular methodology for carrying out the present invention. In step 200, the processor 60 performs general initializations to the developer heating system 20. In step 210, the processor 60 maps at least a portion of the developer 22 into a plurality of grid blocks "XY". In step 220, temperature determinations are made with respect to the various developer portions mapped by the respective grid blocks XY. In step 230, the processor 60 determines if all grid block measurements have been taken. If no, the processor 60 returns to step 220. If yes, the processor 60 analyzes the determined temperature values against a table of acceptable temperature levels for the respective portions of the developer 22. In step 250, the processor 60 determines if any grid block temperature values are not acceptable. If all values grid block temperature values are acceptable, the processor 60 ends this particular iteration of the present methodology and returns to step 220 to perform another iteration. If unacceptable temperature values are found for any of the grid blocks, the processor 60 advances to step 270 where the unacceptable temperature values are analyzed. After the analyses, the processor 60 controls relevant lamps 40 (which correspond to the grid blocks with unacceptable temperature values) to regulate the temperature of the respective developer portions to an acceptable level. The present iteration is then ended and the process returns to step 220 to perform another iteration.

The present invention provides for a system and method for regulating developer temperature. As a result, the present invention facilitates improving developer integrity and reliability which in turn afford for increases in quality of image transfer in lithographic processes employing a developer with temperature regulated in accordance with the present invention.

What has been described above are preferred embodiments of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A system for regulating developer temperature, comprising:

at least one lamp operative to heat a portion of a developer;

a lamp driving system for driving the at least one lamp;

a system for directing radiation to the portion of the developer;

a measuring system for measuring parameters of the developer based on radiation reflected from the developer; and a processor operatively coupled to the measuring system and a lamp driving system, the processor receiving developer parameter data from the measuring system and the processor using the data to at least partially base control of the at least one lamp so as to regulate temperature of at least a portion of the developer.

2. The system of claim 1, the measuring system further including an interferometry system for processing the radiation reflected from the developer.

3. The system of claim 2, the processor being operatively coupled to the interferometry system, the processor analyzing data relating to developer temperature received from the interferometry system, and the processor basing control of the at least one lamp at least partially on the analyzed data.

4. The system of claim 3 the data further relating to thickness of the developer.

5. The system of claim 1, the measuring system further including a spectrometry system for processing the radiation reflected from the developer.

6. The system of claim 5, the processor being operatively coupled to the spectrometry system, the processor analyzing data relating to developer temperature received from the spectrometry system, and the processor basing control of the at least one lamp at least partially on the analyzed data.

7. The system of claim 6, the data further relating to color of the developer.

8. The system of claim 6, the data further relating to absorptivity of the developer.

9. The system of claim 1, the processor mapping the developer into a plurality of grid blocks, and making a determination of developer temperature at a grid block.

10. The system of claim 1, wherein the processor determines the existence of an unacceptable temperature for at least a portion of the developer based upon the determined temperature differing from an acceptable value.

11. The system of claim 10, wherein the processor controls the at least one lamp to regulate the temperature of the developer portion to an acceptable value.

12. The system of claim 1, the developer including a substantially inert material which causes the color of the developer to vary with changes in developer temperature.

13. The system of claim 12, the substantially inert material including europium chelate.

14. A method for regulating developer temperature, comprising the steps of:

defining a developer as a plurality of portions;

directing radiation onto at least one of the portions;

collecting radiation reflected from the at least one portion;

analyzing the reflected radiation to determine the temperature of the at least one portion; and controlling a heating device to regulate the temperature of the at least one portion.

15. The method of claim 14, further including the step of using an interferometry system to process the reflected radiation.

16. The method of claim 15, further including the step of using a processor to control the at least one heating device based at least partially on data received from the interferometry system.

17. The method of claim 14, further including the step of using a spectrometry system to process the reflected radiation.

18. The method of claim 17, further including the step of using a processor to control the at least one heating device based at least partially on data received from the spectrometry system.

19. A method for regulating temperature of a developer, comprising the steps of:

partitioning the developer into a plurality of grid blocks;

using a plurality of heaters to heat the developer, each heater functionally corresponding to a respective grid block;

determining temperatures of portions of the developer, each portion corresponding to a respective grid block; and using a processor to coordinate control of the heaters, respectively, in accordance with determined temperatures of the respective portions of the developer.

20. A system for regulating temperature of a developer, comprising:

means for sensing temperatures of a plurality of portions of the developer;

means for heating the respective developer portions; and means for selectively controlling the means for heating so as to regulate temperature of the respective developer portions.

* * * * *